United States Patent [19]

Zouzoulas

[11] Patent Number: 4,722,519

[45] Date of Patent: Feb. 2, 1988

[54] STACKER APPARATUS

[75] Inventor: John Zouzoulas, West Chester, Pa.

[73] Assignee: Mars, Inc., McLean, Va.

[21] Appl. No.: 904,714

[22] Filed: Sep. 5, 1986

[51] Int. Cl.[4] ..... B65H 29/46

[52] U.S. Cl. ..... 271/181; 271/218; 271/274

[58] Field of Search ..... 271/177, 180, 181, 214, 271/218, 198, 273, 274

[56] References Cited

U.S. PATENT DOCUMENTS 3,912,255 10/1975 McInerny ..... 271/177 X
4,290,594 9/1981 Ludemann ..... 271/180

FOREIGN PATENT DOCUMENTS 58494 5/1979 Japan ..... 271/180
12043 1/1984 Japan ..... 271/180

*Primary Examiner*—Richard A. Schacher
*Attorney, Agent, or Firm*—Davis Hoxie Faithfull & Hapgood

[57] ABSTRACT

An improved banknote stacker is described which achieves reduced levels of jamming and improper stacking. A banknote is directed to a prestorage compartment using a pulley, belt and roller drive assembly. During a pusher cycle, a pusher plate drives the banknote from the prestorage compartment into a banknote storage magazine, and then the pusher plate returns to its original position. Just prior to the pusher cycle, rollers in the roller drive assembly are retracted to release the banknote. The pusher plate is specially designed to prevent banknote slippage, and it is preferably driven by the same drive mechanism which retracts the rollers to insure that a pusher cycle will follow shortly after the retraction of the rollers.

34 Claims, 10 Drawing Figures

STACKER APPARATUS

FIELD OF THE INVENTION

The present invention relates to an improved banknote stacker apparatus for stacking banknotes, paper currency and the like. In particular, stacker apparatus according to the present invention includes refinements to reduce jamming and improper stacking, and represents a further improvement on the apparatus described in my U.S. application Ser. No. 709,559 filed Mar. 9, 1985 which is assigned to the assignee of the present application.

BACKGROUND OF THE INVENTION

In some applications, a banknote stacker must successfully stack banknotes with widely varying characteristics. For example, when used in conjunction with a banknote validator in a vending machine placed in a health club, the stacker may be faced with stacking banknotes ranging from crisp, new, dry banknotes to worn, torn, wet banknotes. Many other extreme examples might be listed, but it suffices to say that a currency stacker preferably should be able to properly stack without jamming widely varying currency under widely varying conditions.

In certain prior art stackers, after validation, a banknote falls by gravity into a compartment which is much wider than the banknote, and then a pusher plate pushes the banknote into a banknote magazine. Understandably, this simple arrangement will achieve poor stacking results if a worn, old banknote falls into the compartment and collapses under its own weight before the pusher plate operates.

Other prior art stackers maintain positive control of a banknote while driving it to a position proximate a pusher plate using pulleys, drive belts, and pinch rollers. In such arrangements, the banknotes are gripped or frictionally held between the driving components located on either side of the banknote. For example, pinch rollers may be mounted on leaf springs to insure that the banknote is adequately pinched or gripped by the pinch rollers. Problems with this kind of arrangement can arise because no matter how carefully such systems are designed, as the pusher attempts to push the banknote into the banknote magazine, the two gripped sides of the banknote will not pull free at exactly the same time. Both improper stacking and jamming can result. For example, if one side of the banknote pulls free and the other does not, the banknote tends to wrap around into a C-shape, and either is not properly stacked or causes a jam when the stacker receives another banknote.

SUMMARY OF THE INVENTION

The present invention addresses problems such as those briefly described above. It is an object of this invention to provide an improved pusher plate that reduces jamming and improper stacking.

It is an object of this invention to provide a retractable pinch roller arrangement that in a first position maintains positive control of a banknote until just prior to the time that the banknote is pushed into a banknote magazine, and that then is retracted to a second position to release the banknote and consequently to reduce jamming and improper stacking. Because the pinch roller arrangement is retractable, the pinch rollers can be designed so that banknotes can be gripped more firmly. Consequently, additional drive force can be generated thereby allowing more positive banknote control during handling.

It is also an object of this invention to provide means for insuring that the retractable rollers are retracted at the appropriate time just before the pusher plate begins a pushing cycle. A cam driven arrangement for achieving this objective is disclosed.

These and other objects will be apparent from the following detailed description. It will also be apparent that an embodiment of the invention need not achieve all of the above objects to come within the scope of the present invention as defined by the claims.

Briefly, an improved banknote stacker according to the present invention typically is employed for stacking banknotes which have been validated by a banknote validator. The improved stacker comprises a banknote magazine for storage of facially stacked banknotes, a prestorage compartment, a pusher means for pushing a banknote in a direction perpendicular to a face of the banknote from the prestorage compartment into the banknote magazine, and banknote transporting means for transporting banknotes to the prestorage compartment. When used in conjunction with a banknote validator, the banknote transporting means transports banknotes from the validator to the prestorage compartment. The improved banknote stacker further includes means for retracting a portion of the banknote transporting means which is located adjacent the prestorage compartment just prior to operation of the pusher means. Additionally, a specially designed pusher plate is provided for preventing slipping of the banknote during the time during which the pusher means pushes the banknote. Also, support arms are provided to further help prevent slippage during pushing, and to prevent the lower portion of a banknote from hanging out of the banknote magazine so that it can interfere with the next banknote which is driven into the prestorage compartment.

Throughout this specification and the claims, where reference is made to a "banknote" or "banknotes", the reference is intended to include all types of paper currency and the like. Similarly, where reference is made to the "face" of a banknote or banknotes, the reference is intended to include either major surface. Further, any banknote will be recognized as having four edges or sides. This specification will refer to the four edges or sides as the leading edge, trailing edge and the two side edges respectively.

DETAILED DESCRIPTION

Figure 1:
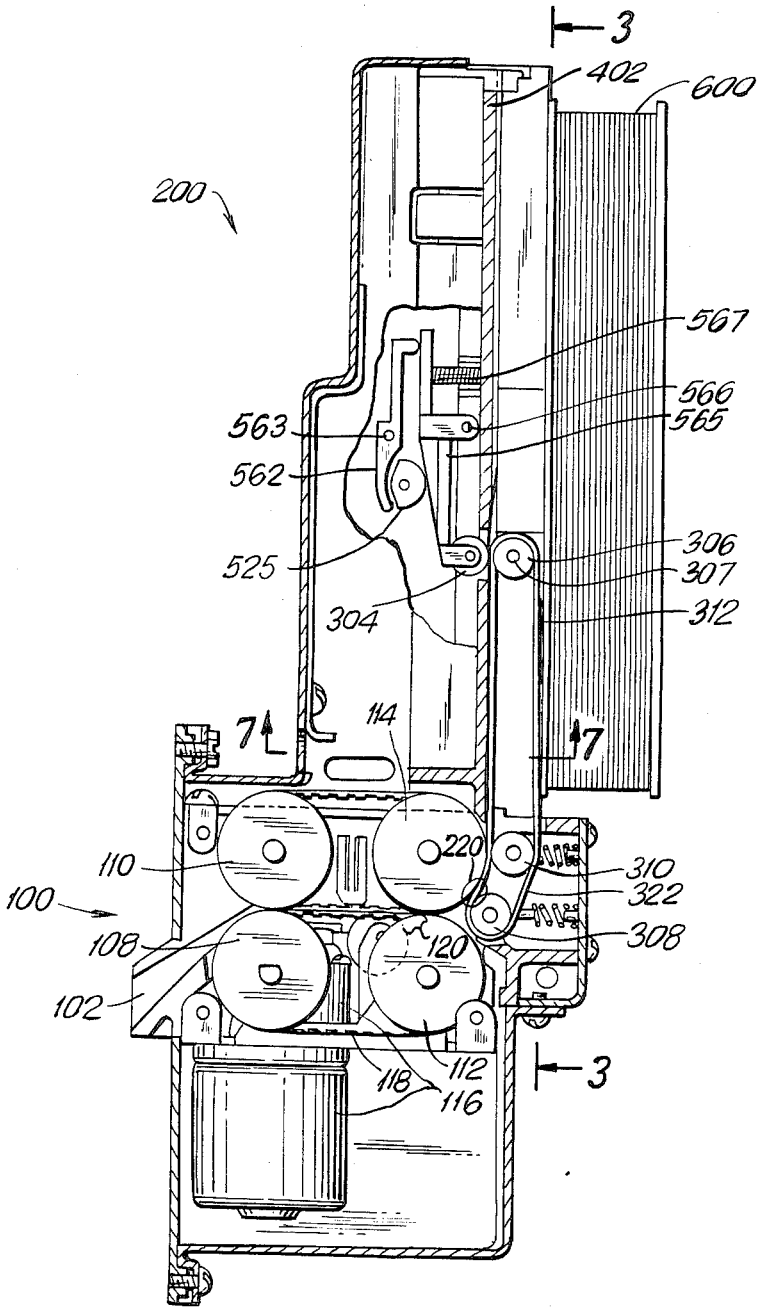
FIG. 1 is an elevational side view of one embodiment of stacker apparatus according to the present invention showing the stacker connected with a readily separable banknote validator unit.

One embodiment of the present invention is shown in FIGS. 1–10. In FIG. 1, an improved stacker 200 according to the present invention is shown connected to a banknote validator 100 to form a validator-stacker unit. The stacker 200 incorporates several major component groups including a banknote transport means 300 (shown in FIG. 2), a pre-storage compartment 400 (shown in FIG. 3), a pusher means 500 (shown in FIG. 4), and a banknote magazine 600 (shown in FIG. 4).

The details of the validator 100 pertaining to banknote validation are not part of this invention. As a result, those aspects of the validator are not discussed further below. Further, various aspects of the electrical and mechanical connection of the validator 100 and the stacker 200 do not form a part of this invention and they also are not further described below.

The validator 100 shown in FIG. 1 is preferably a commercially available unit sold by Mars Electronics, Folcroft, Pennsylvania, U.S.A.; however, it should be recognized that stackers according to the present invention may be used with other commercially available validators or validators which may be subsequently developed. The Mars Electronics validator operates generally as described in U.S. patent application Ser. No. 659,411 filed Oct. 10, 1984 and assigned to the assignee of the present application.

Briefly, validator 100 determines whether inserted banknotes are acceptable. Banknotes are inserted lead edge first one at a time into validator 100 at a banknote entrance 102. From entrance 102, a banknote is transported lengthwise through the validator to the validator's banknote output by a series of pairs of pulleys or rollers 108, 110, 112 and 114 and a pair of belts 118 which grip the side edges of the banknote and which are driven by a drive means 116 including a motor and drive train.

While the banknote is transported through the validator 100, it is tested by a group of sensors to ascertain its validity and denomination. Output signals from the sensors are processed by logic circuits in validator 100 to determine whether the banknote is acceptable. A banknote which is found unacceptable is ejected back through entrance 102 by reversing the drive means 116.

An acceptable banknote is driven by the pairs of belts 118 and the pairs of rollers 112 and 114 into an interconnection region 120 in which the validator 100 and the stacker 200 are connected together. Preferably, interconnection means in the interconnection region 120 establish a smooth uninterrupted path for a banknote to follow in leaving validator 100 and entering stacker 200. The presently preferred interconnection means are described in detail in my earlier application U.S. Ser. No. 709,559. The interconnection means establishes the initial portion of the banknote path in the stacker 200 and serves to direct the leading edge of the banknote to the region 220 where the two side edges of the banknote are gripped between rollers 308, belts 312 and stacker drive rollers 114.

Figure 2:
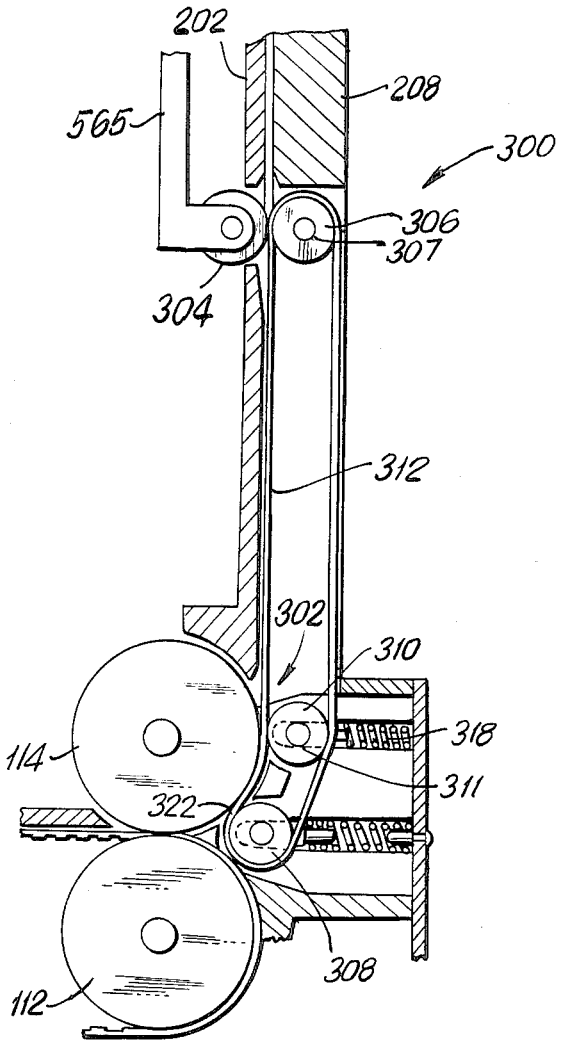
FIG. 2 like FIG. 1 is also a side view, and it shows the details of the banknote transport apparatus of the stacker of FIG. 1 isolated from stacker components not related to the banknote transport apparatus.
Figure 3:
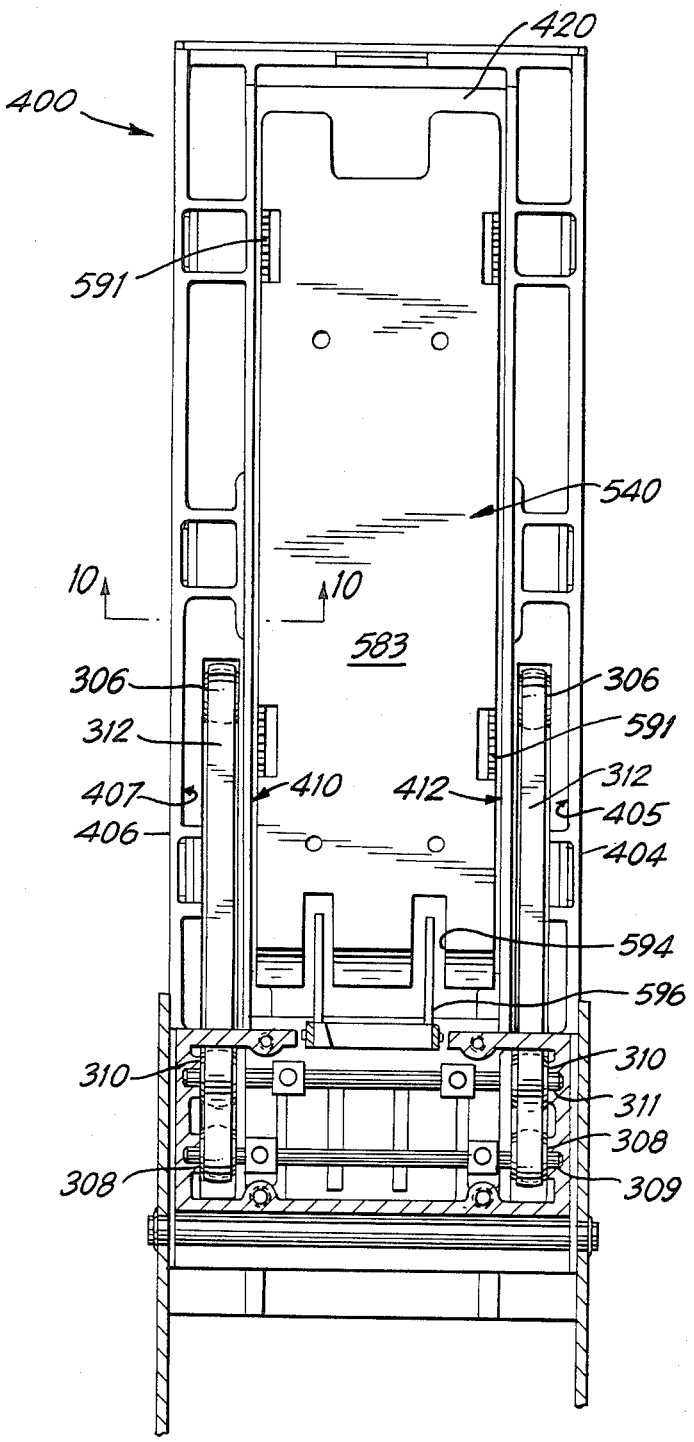
FIG. 3 is a cross-sectional view along section line 3—3 of FIG. 1 showing the prestorage compartment of the stacker of FIG. 1.

As illustrated in greater detail in FIG. 2, stacker 200 includes transport means 300 having a series of pairs of pulleys 306, 308 and 310, a pair of belts 312, and a pair of retractable pinch rollers 304. While FIG. 2 does not show both of each of the pairs of components, it should be recognized that one of each of the above components 306, 308, 310 and 312 is located on each side of the banknote path as is best illustrated in FIG. 3. In the arrangement shown in FIG. 1, the transport means 300 is driven by the validator roller 114.

Transport means 300 transports the accepted banknote from the stacker's entrance into a pre-storage compartment 400, shown in FIG. 3. In a fashion somewhat analogous to the way that a picture frame holds a picture, compartment 400 frames the banknote and holds it stiff prior to stacking. It should be understood that compartment 400 does not "frame" the leading and trailing edges of a banknote but only its two side edges. The prestorage compartment 400 is preferably formed by upper and lower portions of the stacker housing 202 and 208. The central region 420 is open, and a pusher plate 540 which is part of pusher means 500 (shown in FIG. 4) passes through this opening as it strips a banknote from compartment 400, and pushes it in the banknote magazine 600.

After a predetermined amount of time sufficient to allow the accepted banknote to be fully driven into compartment 400 by the transport means 300, the retractable pinch rollers 304 are retracted, and as will be discussed in greater detail in connection with FIGS. 4 and 7–9, pusher means 500 is operated. Pusher means 500 forces the accepted banknote from prestorage compartment 400 into a stack in banknote magazine 600 where it is stored until removed. The magazine 600 is designed to be readily removed or opened so that stacked banknotes can be removed. Now that the overall operation from banknote insertion to stacking and removal has been briefly discussed, the details of apparatus according to the present invention will be described in greater depth.

The preferred embodiment of the present invention is constructed similar to and operates in large part in the same manner as the stacker apparatus shown and described in the applicant's earlier U.S. application Ser. No. 709,559. Consequently, the disclosure of that application is incorporated herein by reference. Some details of that earlier application are repeated herein; however, it should be recognized that the scope of the present invention is defined by the claims of this application which are not limited to the specific details of the preferred embodiment. The emphasis of the present disclosure is on describing the applicant's present improvements.

BANKNOTE TRANSPORT MEANS

As the leading edge of the banknote reaches region 220 (shown in FIG. 1) of the stacker 200, it begins to enter the stacker's banknote transport means 300. At this point, the banknote's two side edges begin to be gripped between the pulleys 308, belts 312 and validator drive rollers 114. From the region 220, the banknote is further driven by transport means 300 until its leading edge first reaches the pulleys 310, then reaches the pulleys 306 and pinch rollers 304, and finally until the leading edge reaches stop 402 at the top of prestorage compartment 400. Once the trailing edge of the banknote is clear of the stacker driving rollers 114 and the pulleys 310, the locating pulleys 306, belts 312 and the pinch rollers 304 continue to grip the banknote and drive the banknote fully into compartment 400.

Both the pulleys 310 and 308 are spring mounted so that the overall belt-pulley arrangement 302 is self adjusting. The pulleys 306 are mounted on and free to rotate about respective pulley pins 307 which are secured to respective walls of prestorage compartment 400 in a fixed position relative to the banknote path. In a first drive position, the pinch rollers 304 are located in stacker housing 202 opposite their respective locating pulleys 306. The pinch rollers 304 are held in a pinch roller arm 565, which is biased by a spring 567 in a first drive position so that in conjunction with belts 312 and pulleys 306, the rollers 304 grip the two side edges of a banknote. Because the pinch rollers 304 are retracted before the pushing cycle begins, spring 567 can be selected so that the pinch rollers 304 provide greater banknote gripping force. This additional gripping force also allows for less overdriving while still insuring that banknotes will be driven fully into compartment 400. The spring 567 also provides sufficient force to prevent the banknote from slipping once the banknote has been fully driven into prestorage compartment 400; however, this force is insufficient to crumple or jam a bill and it is small enough so that belt 312 slips against the banknote from the time when the banknote's leading edge reaches stop 402 until drive roller 114 is stopped. In the preferred embodiment, driver roller 114 is operated for a predetermined time which is slightly longer than that required to drive the leading edge of a banknote to the stop 402, and then it is turned off. With this controlled slippage, it is not necessary to provide a sensor to sense when a banknote is fully in or nearly fully in prestorage compartment 400 in order to provide a control signal to immediately turn off drive means 116 to prevent jamming or crumpling of the banknote. Such a sensor and associated control circuitry may be readily added, but such an addition adds overall cost and complexity to the system. While a small amount of overdrive is still presently preferred, the present system includes less overdrive than was preferred with apparatus according to my prior application U.S. Ser. No. 709,559.

PRESTORAGE COMPARTMENT

Figure 7:
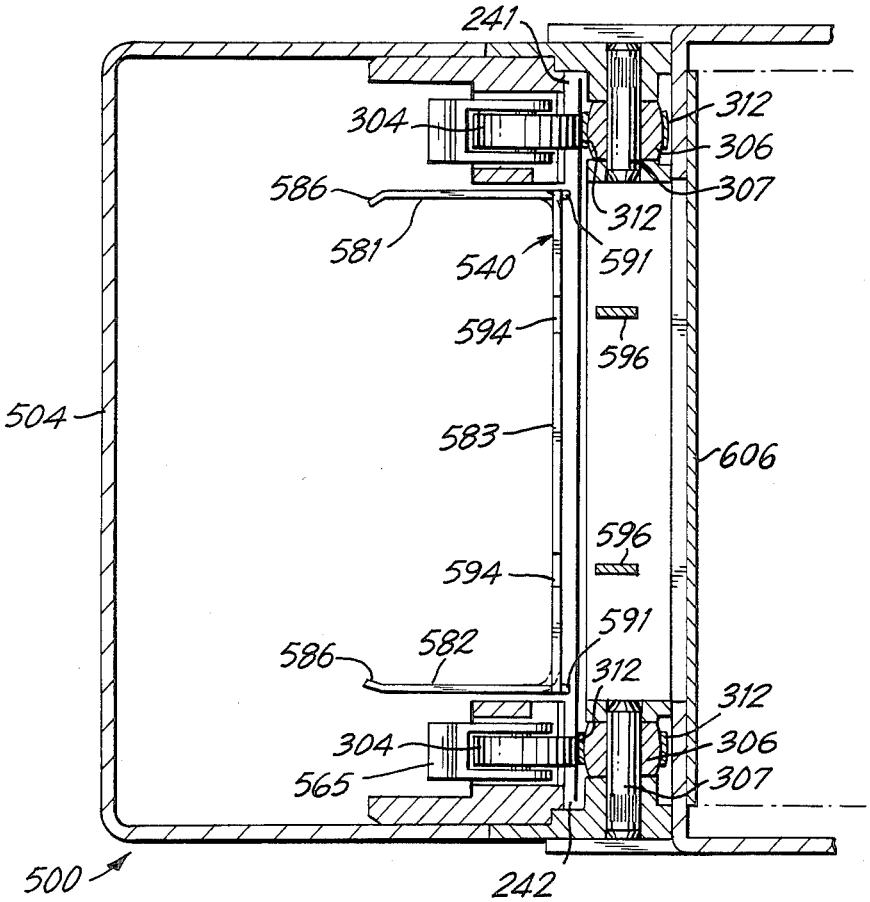
FIG. 7 is a top sectional view along section line 7—7 of FIG. 1 showing a banknote in the prestorage compartment with the retractable roller arrangement in a first driving position.

In the preferred prestorage compartment such as the prestorage compartment 400 shown in FIG. 3, the two side edges of the banknote are held in channels 241 and 242 (best seen in FIG. 7). The banknote passageway defined by these channels has a predetermined width in a direction perpendicular to the face of the banknote. Preferably, this width is approximately ten times the thickness of a typical banknote. The channel size is determined by the design and fabrication of the stacker's upper housing 202 and lower housing 208 (best seen in FIG. 2) which together define the prestorage compartment 400.

The prestorage compartment 400 is shown in detail in FIG. 3. The inner surfaces 405 and 407 of outer sidewalls 404 and 406 of prestorage compartment 400 are spaced apart by a distance slightly greater than the width of the widest banknote which is to be accepted. Inner sidewalls 410 and 412 define the width of the channels 241 and 242 (shown in FIG. 7) in which the side edges of the banknote travel. The central portion of prestorage compartment 400 is an open window 420 which is larger than the pusher plate 540 which is used to push the banknote from compartment 400 into banknote magazine 600.

Pusher

Figure 4:
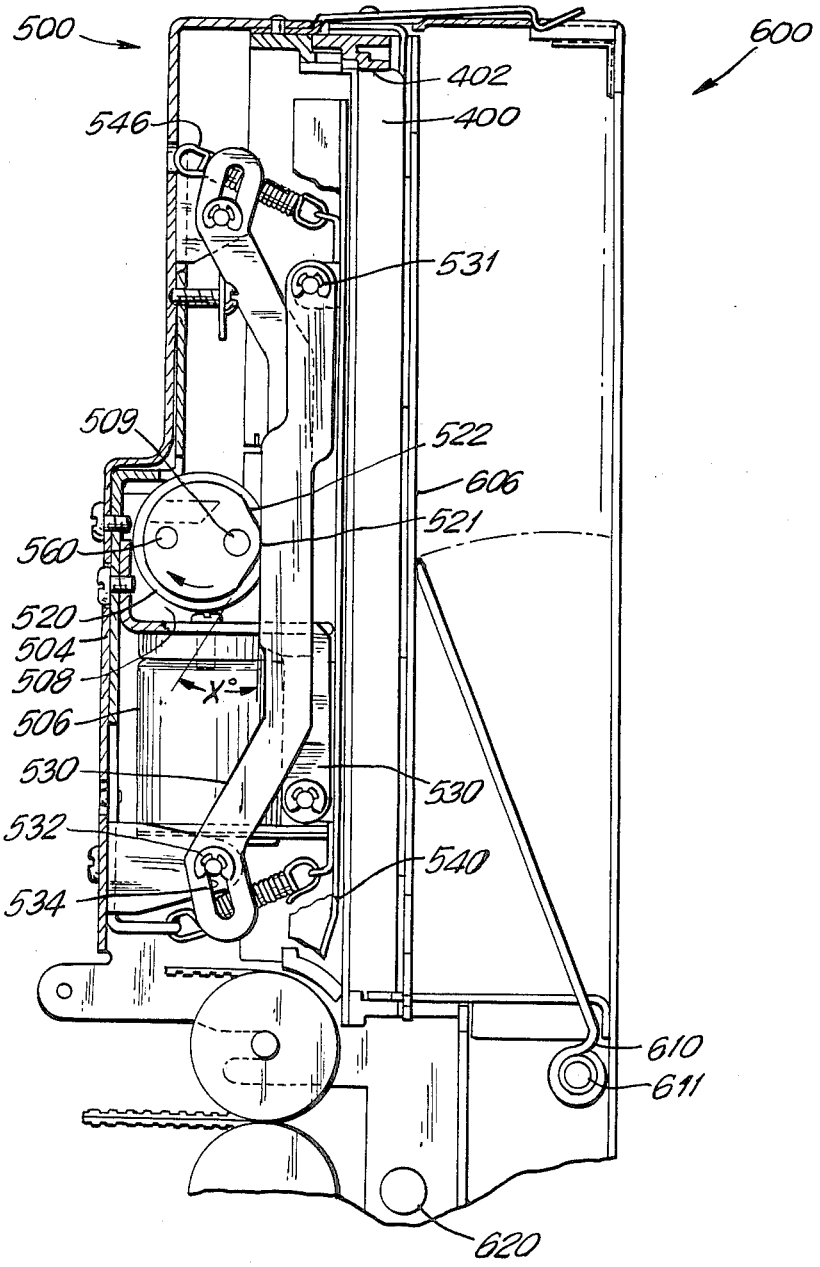
FIG. 4 is an elevational side view with the stacker housing cutaway to illustrate details of the pusher and banknote magazine of the stacker of FIG. 1.

While pusher plate 540 is shown in FIG. 3, the overall pusher 500 is best illustrated in FIG. 4. Pusher 500 includes a pusher actuating mechanism consisting of a chassis 504, motor 506, right angle gear train 508, two cams 520 mounted on the gear train output shaft, a pair of scissors 530, a pusher plate 540 and extension springs 546. Each scissor 530 is supported at one end by a clevis pin 531 to the pusher plate 540 and at the other end by a second clevis pin 532 to the chassis 504 through an elongated slot 534. Additionally, each scissor 530 is held against one of the cams 520 by means of the force exerted by the springs 546.

The cams 520 are eccentric and have two cam surfaces. On one side is the cam surface 521 upon which the scissors rest. On the other side is the cam surface 525 (FIGS. 2 & 5) which drives the retractable roller arrangement, and which is described further below. The cams 520 are mounted on shaft 509 of gear train 508, and they rotate when motor 506 causes gear train 508 to turn the gear train shaft 509. Home position of the pusher plate 540 and scissors 530 is defined when the pusher plate and scissors are in their closest proximity to shaft 509 as shown in FIG. 4. The home position is maintained over a large range of cam position by providing two flat cam sides 522 as part of cam surface 521. As the cam rotates about its axis through the region determined by the flat sides 522 of cam surface 521, no motion is imparted by cam 520 to scissors 530 and pusher plate 540. Once cam 520 has rotated through the region defined by the flat sides 522, the round portion of cam surface 521 begins to move the scissors 530 and pusher plate 540 through the window 420 in the prestorage compartment 400. Cam surface 521 preferably includes two flat sides at an angle of x degrees as shown in FIG. 4. In the preferred embodiment, the angle x is approximately 45 degrees. As pusher plate 540 is forced through window 420, a banknote in prestorage compartment 400 is moved into banknote magazine 600. As the cam 520 continues to rotate, the scissors 530 finally are fully extended.

For pusher means 500 to function properly, it is necessary to control the time at which pusher means 500 is turned on thereby causing a pusher cycle 500 to begin. A drive means, such as the motor 506, should be turned on shortly after a banknote has fully entered prestorage compartment 400. The pusher plate 540 should not begin to push through the opening 420 when there is no bill in compartment 400 or when a bill is only part way into the compartment 400. It is also necessary to control the time at which motor 506 is turned off to insure that the pusher plate has returned to its beginning position before stacker 200 attempts to drive another banknote into compartment 400.

In the present embodiment, a control signal to turn motor 506 on so that cam 520 rotates clockwise is produced after a sufficient time has passed for an accepted banknote to fully enter the prestorage compartment 400. Alternatively, a banknote position sensor may be used to sense that a banknote is in the proper position for stacking, and a start control signal would then be produced in response to a signal from that banknote position sensor. Following a motor on signal, cams 520 begin to rotate. The pusher plate 540 pushes the banknote through opening 420 and into the banknote magazine 600. The banknotes already in magazine 600 are clamped between the pusher plate 540 and pressure plate 606 which in turn is exerting a force against pressure spring 610. Once the pusher plate returns to its home position, it is necessary to sense that the pusher cycle has been completed and to turn off motor 506. One embodiment for doing this is described in U.S. Ser. No. 709,559. The presently preferred embodiment for sensing the end of the pusher cycle is to embed a magnet 560 in the face of cam surface 521, and to sense the position of magnet 560 using a Hall effect sensor 561 (shown in FIG. 10) mounted on a printed circuit board 569 which is attached to the stacker housing. The Hall effect sensor 561 produces an output signal when the cam 520 has completed a cycle, and this output signal is suitably processed by logic control circuitry and used to control that the motor 506 is turned off at the proper time.

Retractable Roller Arrangement

Figure 5:
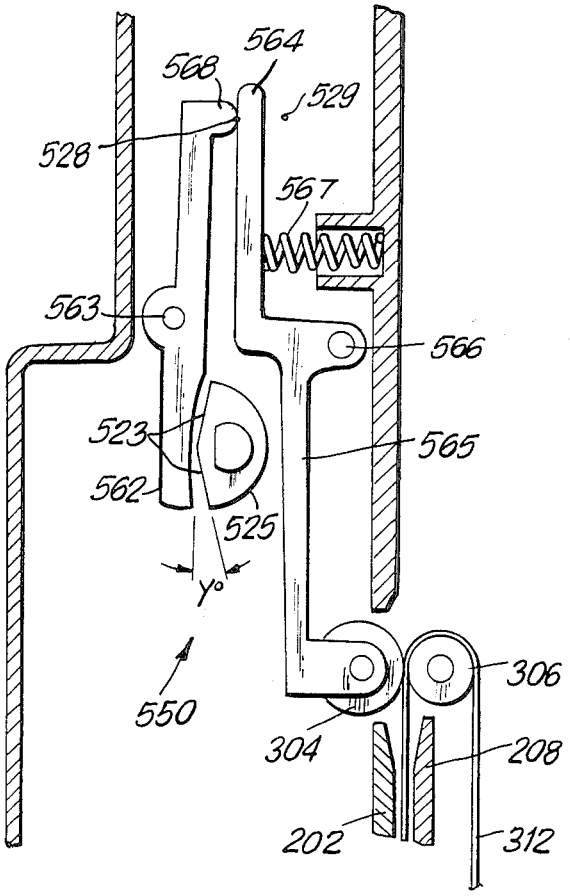
FIG. 5 is a crosssectional enlargement of the upper portion of FIG. 1 showing in isolation the details of the drive apparatus for controlling the retracting of the retractable rollers.
Figure 8:
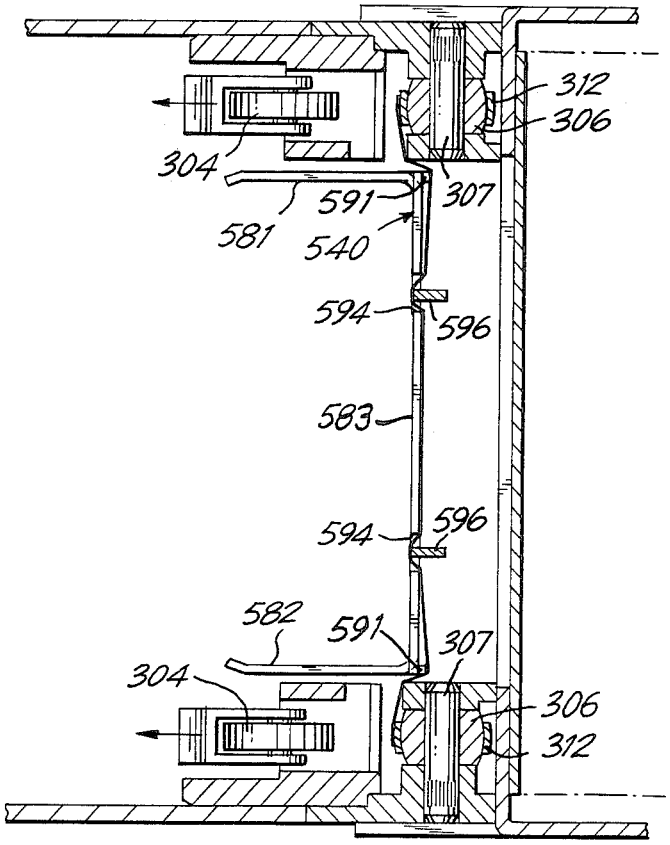
FIG. 8 is a second top sectional view in which the retractable roller arrangement has been retracted to a second position and the pusher plate is beginning to strip the banknote out of the prestorage compartment and push it into the banknote magazine.
Figure 9:
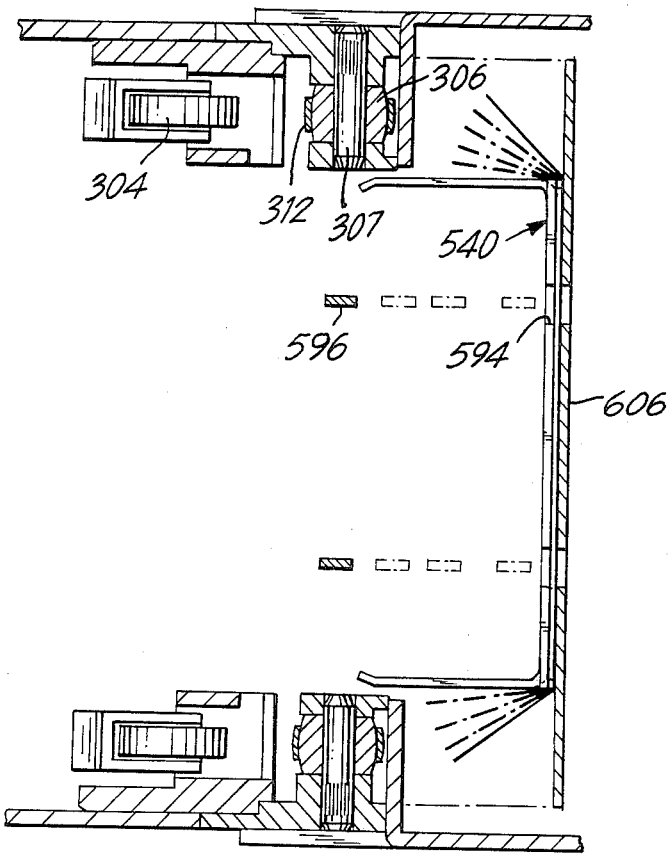
FIG. 9 is a third top sectional view illustrating a later stage in the cycle of operation of the pusher.
Figure 10:
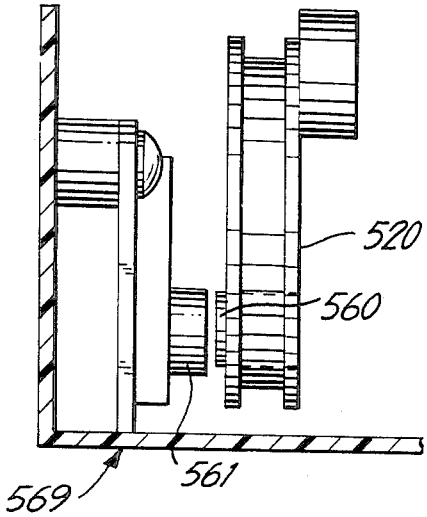
FIG. 10 is a sectional view along section line 10—10 of FIG. 3 illustrating the mounting of a Hall effect sensor for sensing cam position.

According to the present invention, a means is provided for releasing the gripping force on the banknote just prior to the time when the banknote is pushed out of the prestorage compartment 400. One suitable means for releasing is a retractable roller arrangement 550 which is illustrated in FIGS. 5 and 7–9. FIG. 5 shows an arrangement used to insure that the pinch rollers 304 are retracted just prior to the time at which the pusher cycle begins. FIGS. 7–9 illustrate how retracting the rollers 304 contributes to reduced jamming and a reduction in improper stacking.

The cam surface 525 which is located on the opposite side of the cam 520 from cam surface 521 which powers the pusher 500 is shown in FIG. 5. Cam surface 525 drives an actuating cam fork 562. Fork 562 is supported by and pivots around a pin 563. When the fork 562 pivots around pin 563, its end 568 in turn moves the end 564 of the pinch roller arm 565. The rollers 304 are mounted at the other end of the pinch roller arm 565. Consequently, as arm 565 pivots around pin 566, the rollers 304 are retracted and their grip on the banknote is released. In the absence of the influence of the fork 562, spring 567 biases arm 565 to a first drive position in which the rollers 304 are not retracted. The cam surface 525 of cam 520 is designed so that whenever the pusher plate 540 is in its home position, the arm 565 is in the first position and the pinch rollers 304 provide gripping force for holding or driving a banknote. The cam surface 525 is also designed so that when the cam 520 starts to operate, the rollers 304 will be retracted a short predetermined time before the pusher plate begins to move.

The movements of the fork 562 and arm 565 are determined by virtue of the cam shape on cam surface 525 just as discussed for cam surface 521. Cam surface 525 preferably includes two flat sides 523 at an angle of y degrees as shown in FIG. 5. In the preferred embodiment the angle y is approximately 20 degrees, and the rollers 306 are retracted approximately 10 ms (milliseconds) before the pusher plate 540 begins to move.

To summarize, when cam 520 rotates, cam surface 525 rotates and causes fork 562 to pivot. This causes the end 563 of fork 562 to move from position 528 to position 529. This in turn causes the roller arm 565 to pivot about pin 566 against the force of spring 567 thereby retracting the rollers 304.

While the above described retractable roller arrangement is shown as used with particular preferred transport means 300, prestorage compartment 400, and banknote magazine 600, in other embodiments, it might be used with any suitable banknote positioning means for receiving banknotes from a validator and positioning them properly relative to the pusher plate 540, and any suitable banknote storage compartment for facially stacking banknotes. Similarly, while a particular retractable roller arrangement is shown and described, other arrangements might be used to maintain positive control over a banknote and then release that control at the appropriate time.

Pusher Plate

Figure 6:
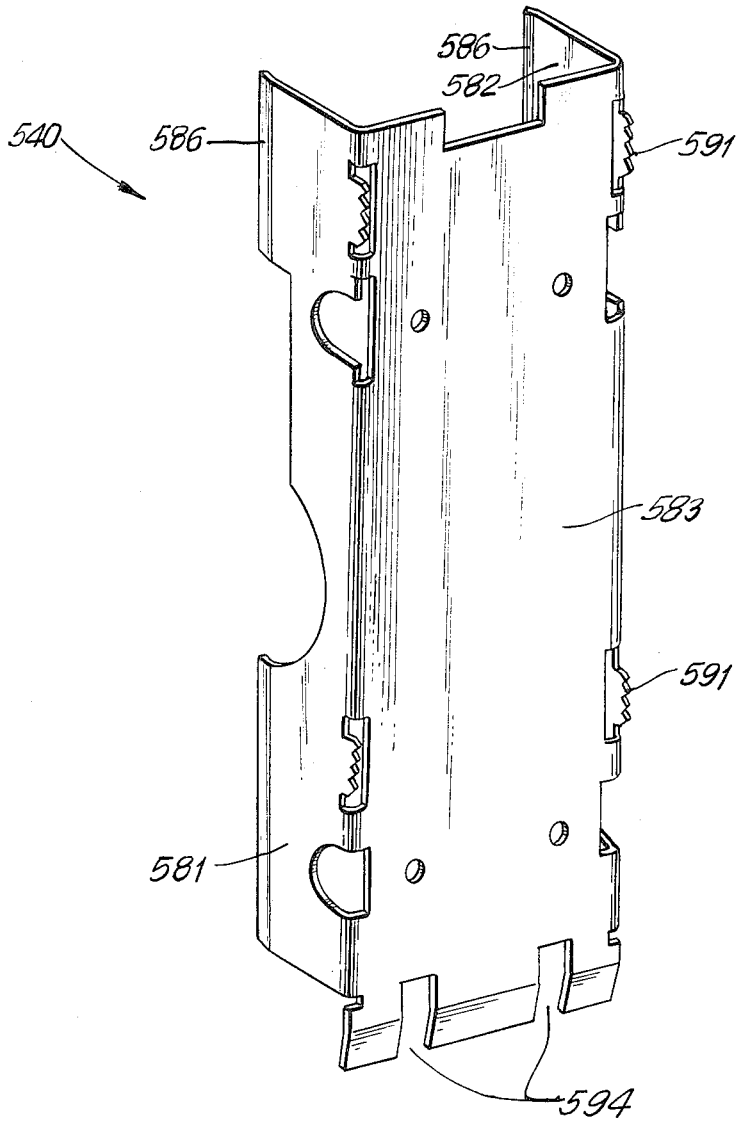
FIG. 6 is an isometric drawing illustrating the details of the pusher plate for the stacker of FIG. 1.

FIG. 6 illustrates details of the improved pusher plate 540 which is used in the preferred embodiment of the stacker 200 of the present invention.

The operation and advantages of pusher plate 540 are also illustrated in FIGS. 7–9. As shown in FIGS. 6–9, the pusher plate 540 has a U-shaped crosssection defined by sidewalls 581 and 582 which are connected by a pusher face 583. The sidewalls 581, 582 extend the length of pusher face 583 and their height h exceeds the length of the portion of the banknote which extends beyond the pusher face 583 on either side. Preferably, these sidewalls 581, 582 make an angle with respect to pusher face 583 which is slightly less than a right angle. This angling insures that the pusher plate 540 is self-seating as it returns to its home position after it has been fully extended, and that the sidewalls 581, 582 will not catch during the return to home position. In the preferred embodiment, this angle is 88°. Additionally, the sidewalls 581, 582 are provided with slightly curled ends 586.

Pusher plate 540 also includes sets of teeth 591 located at the edges of the pusher face 583 where the sidewalls 581, 582 attach to face 583. Finally, the pusher plate 540 includes slots 594. As shown in FIG. 3, the slots 594 are aligned with support arms 596 whose operation is described below.

Reduction In Jamming And Improper Stacking

The above discussion describes apparatus according to the present invention. The following discussion describes how that apparatus operates to reduce jamming and improper stacking. Turning to FIGS. 7–9, FIG. 7 shows a banknote in the prestorage compartment 400 ready for stripping or pushing out of compartment 400 and for stacking in banknote magazine 600. In this position prior to beginning of a pusher cycle, it is seen that the edges of the banknote are clamped between the lefthand and righthand sets of pulleys 306, belts 312 and rollers 304. The support arms 596 stand clear of the banknote in a region between the prestorage compartment 400 and banknote magazine 600. If the rollers 304 are not retracted when the pusher plate 540 begins to push the banknote, each of the ends of the banknote will tend to frictionally slide between the respective pulleys, belts and rollers holding it until it comes free. Because even under the best of circumstances the frictional forces will not be exactly equal, one end of the banknote will come free first. Under some circumstances, the other end will come free sufficiently later in time or not at all, and as a result improper stacking or jamming will occur when pusher plate 540 operates.

The present invention solves such problems. In FIG. 8, the rollers 304 have been retracted and pusher plate 540 is shown beginning to strip the banknote from the prestorage compartment 400. The support arms 596 now press the banknote against the pusher plate 540 and force part of the banknote to press into the slots 594 of the pusher plate 540. This arrangement helps prevent the banknote from slipping back down the banknote path during stripping, and along with the teeth 591, 592 prevents the banknote from sliding sideways as the side edges of the banknote pull free from channels 241 and 242. Additionally, sidewalls 581, 582 prevent the ends of the banknote from wrapping in behind the pusher face 583 thereby eliminating a potential source of jamming and improper stacking.

FIG. 9 illustrates the result of further movement of pusher plate 540. As the pusher plate 540 moves further, it clamps the banknote against the spring loaded pressure plate 606 of the banknote magazine 600. In FIG. 9, the banknote is shown stripped from the prestorage compartment 400. At this time, the ends of the banknote spring open, and the spring loaded support arms 596 spring back to their original position shown in FIG. 7. After this point in time, the pusher plate 540 begins its return home. Once pusher plate 540 returns home, the stacker is ready to stack another banknote. After the pusher plate 540 has passed support arms 596 on its return home, the arms 596 serve the additional purpose of preventing the lower portion of the banknote, which has just been transferred to banknote magazine 600, from sticking back into the banknote path. Thus, the arms 596 help prevent an additional cause of jamming.

I claim:

1. An improved banknote stacker for stacking banknotes which have been validated by a banknote validator, the stacker comprising a banknote magazine for storage of facially stacked banknotes;

a prestorage compartment;

a pusher means for pushing a banknote in a direction perpendicular to a face of banknote from the prestorage compartment into the banknote magazine;

banknote transporting means for gripping the side edges of the banknote and transporting the banknote to said prestorage compartment;

wherein the improvement comprises:

means for releasing the gripping of the banknote by the banknote transporting means just prior to operation of the pusher means.

2. The apparatus of claim 1 wherein the banknote transporting means includes belts, pulleys and pinch rollers which are arranged to transport the banknote to the prestorage compartment by gripping the side edges of the banknote, and the means for releasing comprises means for retracting the pinch rollers.

3. The apparatus of claim 2 wherein the pinch rollers are mounted on a roller arm which is pivotally mounted and spring-biased into a first position in which the pinch rollers grip the side edges of the banknote.

4. The apparatus of claim 3 wherein the means for retracting causes the pinch rollers to be retracted a predetermined short period of time before the pusher means begins to push a banknote.

5. The apparatus of claim 4 wherein the means for retracting causes the pinch rollers to be retracted approximately 10 ms before the pusher means begins to push a banknote.

6. The apparatus of claim 3 wherein the means for retracting further comprises a drive means for driving a cam having a first cam surface, and an actuating cam fork which is driven by the first cam surface to transmit force to an end of the roller arm thereby causing the roller arm to pivot and the pinch rollers to be retracted thereby causing the pinch rollers to release the side edges of the banknote.

7. The apparatus of claim 6 wherein the cam driven by the drive means further comprises a second cam surface which actuates the pusher means.

8. The apparatus of claim 7 wherein the first and second cam surfaces cause the pinch rollers to be retracted a predetermined short period of time before the pusher means begins to push a banknote.

9. The apparatus of claim 8 wherein the first and second cam surfaces cause the pinch rollers to be retracted approximately 10 ms before the pusher means begins to push a banknote.

10. The apparatus of any one of claims 1–9 wherein the pusher means further comprises a U-shaped pusher plate having sidewalls connected by a pusher face.

11. The apparatus of claim 10 wherein the pusher plate further comprises teeth located at the edges of the pusher face.

12. The apparatus of claim 10 wherein the height of eaoh of the sidewalls exceeds the length of that portion of the banknote which extends beyond the width of the pusher face.

13. The apparatus of claim 10 wherein the sidewalls make an angle with respect to the pusher face of slightly less than 90°.

14. The apparatus of claim 10 wherein the lower portion of the pusher face has at least one slot cut in it.

15. The apparatus of claim 14 wherein the stacker further comprises means for preventing the banknote from slipping out of the prestorage compartment during the time when the pinch rollers have been retracted and the pusher plate is beginning to strip the banknote out of the prestorage compartment.

16. The apparatus of claim 15 wherein the means for preventing the banknote from slipping further comprises at least one spring loaded arm which is aligned with the pusher face slot, said spring loaded arm tending to clamp the banknote against the pusher face.

17. The stacker of claim 1 wherein the prestorage compartment is defined by an upper and a lower housing, said prestorage compartment framing the side edges of the banknote and having an open center through which the pusher means can push through.

18. The apparatus of claim 17 wherein the banknote transporting means includes belts, pulleys and pinch rollers which are arranged to transport a banknote to the prestorage compartment by gripping the side edges of the banknote, and the means for releasing comprises means for retracting the pinch rollers.

19. The apparatus of claim 18 wherein the pinch rollers are mounted on a roller arm which is pivotally mounted and spring-biased into a first position in which the pinch rollers grip the side edges of the banknote.

20. The apparatus of claim 19 wherein the means for retracting causes the pinch rollers to be retracted a predetermined short period of time before the pusher means begins to push a banknote.

21. The apparatus of claim 20 wherein the means for retracting causes the pinch rollers to be retracted approximately 10 ms before the pusher means begins to push a banknote.

22. The apparatus of claim 19 wherein the means for retracting further comprises a drive means for driving a cam having a first cam surface, and an actuating cam fork which is driven by the first cam surface to transmit force to an end of the roller arm thereby causing the roller arm to pivot and the pinch rollers to be retracted so that the pinch rollers no longer grip the side edges of the banknote.

23. The apparatus of claim 22 wherein the cam driven by the drive means further comprises a second cam surface which actuates the pusher means.

24. The apparatus of claim 23 wherein the first and second cam surfaces cause the pinch rollers to be retracted a predetermined short period of time before the pusher means begins to push a banknote.

25. The apparatus of claim 24 wherein the first and second cam surfaces cause the pinch rollers to be retracted approximately 10 ms before the pusher means begins to push a banknote.

26. The apparatus of any one of claims 17–25 wherein the pusher means further comprises a U-shaped pusher plate having sidewalls connected by a pusher face.

27. The apparatus of claim 26 wherein the pusher plate further comprises teeth located at the edges of the pusher face.

28. The apparatus of claim 27 wherein the height of the sidewalls exceeds the length of that portion of the banknote which extends beyond the width of the pusher face.

29. The apparatus of claim 27 wherein the extended sidewalls make an angle with respect to the pusher face of slightly less than 90°.

30. The apparatus of claim 29 wherein a lower portion of the pusher face has at least one slot cut in it.

31. The apparatus of claim 30 wherein the stacker further comprises means for preventing the banknote from slipping out of the prestorage compartment during the time when the pinch rollers have been retracted and the pusher plate is beginning to strip the banknote out of the prestorage compartment.

32. The apparatus of claim 31 wherein the means for preventing the banknote from slipping further comprises at least one spring loaded arm which is aligned with the pusher face slot, said spring loaded arm tending to clamp the banknote against the pusher face.

33. The apparatus of claim 23 further comprising a magnet embedded in the second cam surface and a Hall effect sensor for producing a signal to indicate the location of the cam.

34. An improved banknote stacker for stacking banknotes which have been validated by a banknote validator, the stacker comprising a banknote magazine for storage of facially stacked banknotes;

a prestorage compartment;

a pusher means for pushing a banknote in a direction perpendicular to a face of banknote from the prestorage compartment into the banknote magazine;

banknote transporting means for gripping the side edges of the banknote and transporting the banknote to said prestorage compartment;

wherein the improvement comprises:

a support arm spring mounted in a region between the prestorage compartment and the banknote magazine and located proximate to the lower portion of the prestorage compartment; and the pusher means further comprising a slot aligned with the support arm.

* * * * *